United States Patent [19]

Belliveau

[11] Patent Number: 5,061,873

[45] Date of Patent: Oct. 29, 1991

[54] INCANDECENT LAMP HAVING HIGH RESISTANCE TO FILAMENT DAMAGE FROM VIBRATION AND SHOCK

[75] Inventor: Stephen D. Belliveau, Aurora, Ohio

[73] Assignee: General Electric Company, Schenectady, N.Y.

[21] Appl. No.: 474,581

[22] Filed: Feb. 2, 1990

[51] Int. Cl.[5] ..... H01J 1/88

[52] U.S. Cl. ..... 313/271; 313/269; 313/278

[58] Field of Search ..... 313/269, 278, 271, 115, 313/315, 272

[56] References Cited

U.S. PATENT DOCUMENTS

| | | | |
|---|---|---|---|
| 3,366,826 | 1/1968 | Rainone | 313/269 |
| 3,530,329 | 9/1970 | Stone et al. | 313/278 |
| 4,131,819 | 12/1978 | Graves | 313/271 |
| 4,835,443 | 5/1989 | Benson et al. | 313/315 |
| 4,876,482 | 10/1989 | Stadler | 313/271 |

*Primary Examiner*—Donald J. Yusko
*Assistant Examiner*—Nimeshkumar D. Patel
*Attorney, Agent, or Firm*—George E. Hawranko; Stanley C. Corwin; Fred Jacob

[57] ABSTRACT

This incandescent lamp includes an envelope, a fine-wire filament within the envelope, and lead wires supported on the envelope and having inner portions within the envelope connected to opposite ends of the filament. The filament is rendered high resistant to damage from vibration and shock by: (a) stiffening the filament with a support wire connected between the envelope and an intermediate point on the filament and (b) constructing the inner lead-wire portions in such a manner that the natural frequency of the filament is between 1.7 and 2.2 times the natural frequency of each inner lead-wire portion.

12 Claims, 2 Drawing Sheets

INCANDECENT LAMP HAVING HIGH RESISTANCE TO FILAMENT DAMAGE FROM VIBRATION AND SHOCK

This invention relates to an incandescent lamp having a fine-wire filament and, more particularly, relates to a lamp of this type that can withstand appreciable vibration and shock without damage to its filament.

BACKGROUND

In certain applications of incandescent lamps, e.g., in automobile lighting, the lamp may be subjected to appreciable vibration and mechanical shock. Such vibration and shock can result from engine operation, travel over rough roads, impact to the car, and similar conditions. If the filament of such a lamp is of relatively heavy wire, e.g., the type typically used for brake lights, it can readily withstand such vibration and shock without damage But if the filament is of the relatively fine-wire type, e.g., the type typically used for parking lights, it is usually much less rugged and much more suspectible to damage by such vibration and shock.

Efforts have previously been made to reduce the chance for damage to such fine-wire filaments by supporting the lamp on cushioning means that is capable of limiting the amount of vibration energy transmitted to the lamp. But the addition of such cushioning means for mounting the lamp involves extra expense that automobile manufacturers, understandably, prefer to avoid.

OBJECTS

An object of my invention is to construct an incandescent lamp having a fine-wire filament in such a manner that the filament is well protected against damage from shock and vibration without need to rely upon cushioning means for mounting the lamp.

Another object is to protect the filament of such a lamp from vibration and shock by constructing the components within the lamp envelope in such a manner that they have natural frequencies so related to each other that the filament is highly resistant to damage from vibration.

Still another object is to protect the filament of such a lamp from vibration and shock by constructing the internal lead and support wires for the filament in such a manner as to materially reduce the transmissibility of vibrations therethrough and in such a manner as to preclude damaging conditions of resonance from developing.

SUMMARY

In carrying out my invention in one form, I provide an incandescent lamp that comprises an envelope, a pair of lead wires extending into the envelope, sealing structure through which the lead wires enter the envelope for supporting the lead wires, a refractory metal filament within the envelope having two ends respectively connected to the lead wire, and a support wire connected between such sealing structure and a point on the filament spaced from the ends of the filament. Each lead wire includes an inner lead-wire portion extending between the sealing structure and the filament. These inner lead-wire portions have substantially the same natural frequencies, and the filament has a natural frequency of between 1.7 and 2.2 times the natural frequency of each of the inner leadwire portions when the lamp is deenergized.

BRIEF DESCRIPTION OF FIGURES

For a better understanding of the invention, reference may be had to the following detailed description of one embodiment of the invention taken in connection with the accompanying drawings, wherein.

DETAILED DESCRIPTION OF EMBODIMENTS

Figure 1:
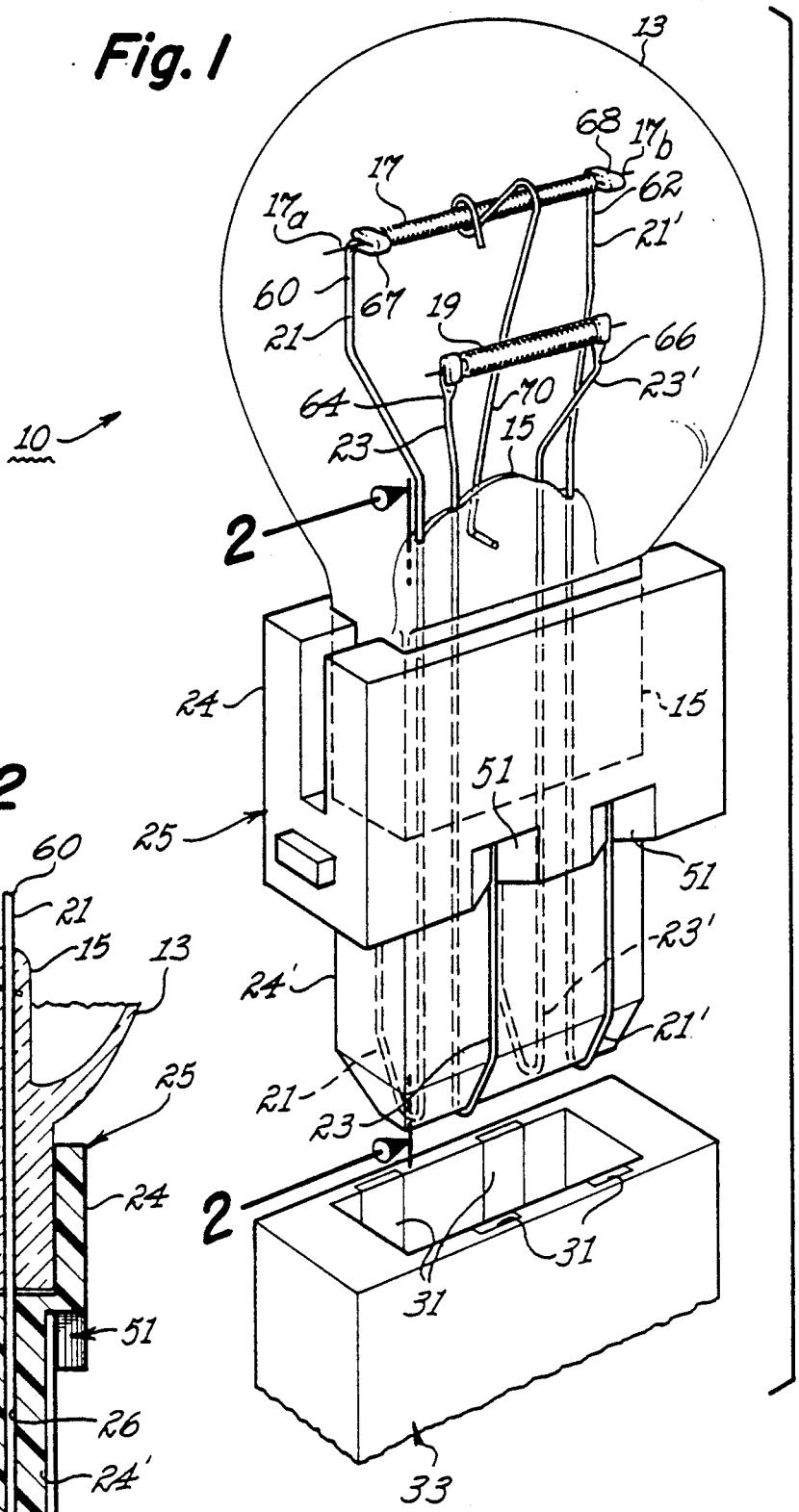
FIG. 1 is a perspective view of an incandescent lamp embodying one form of my invention. In addition, a socket for the lamp is shown.

Referring now to FIG. 1, the incandescent lamp 10 shown therein comprises a light-transmitting envelope in the form of a glass bulb 13, the bulb in one embodiment containing a rare gas such as argon at approximately atmospheric pressure. Bulb 13 is press, or pinch, sealed at one end by a conventional press sealing operation. This press-sealing operation forms a flattened, sealed end portion 15 as part of the bulb 13 adjacent the bulbous portion of the envelope. End portion 15, which is also referred to herein as sealing structure, is of a substantially rectangular form when viewed in transverse cross section in a horizontal plane.

Located within the envelope 13 is a pair of filaments 17 and 19. Each of these filaments is supported within the envelope by a pair of spaced-apart lead wires that extend in sealed relationship through the sealed end portion 15 of the envelope. In the region where the lead wires extend through the sealed end portion, or sealing structure, the lead wires are rigidly secured to the sealing structure as a result of the above-noted press-sealing operation, which compresses the then-softened glass about the lead wires.

Each of the lead wires comprises, within the envelope, an inner lead-wire portion that extends between the sealed end portion 15 of the envelope and one end of the associated filament. The extreme end of each of the inner lead-wire portions is joined to its associated filament by being bent or crimped about the end of the associated filament.

In FIG. 1 the lead wires that support filament 17 are designated 21 and 21', and the lead wires that support filament 19 are designated 23 and 23' . The inner lead-wire portions of lead wires 21 and 21' are respectively designated 60 and 62. The inner lead-wire portions of lead wires 23 and 23' are respectively designated 64 and 66. The extreme ends of the lead wires 21 and 21' are shown at 67 and 68 crimped around the ends **17*a* and 17*b* of the filament 17. The extreme ends of the other lead wires 23 and 23' are shown similarly crimped about the ends of the other filament 19**.

Figure 2:
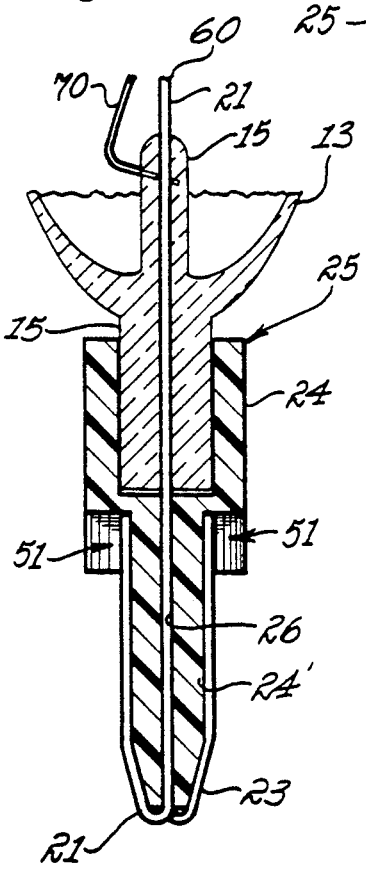
FIG. 2 is a sectional view of the lamp of FIG. 1 taken in a vertical plane including the line 2—2 of FIG. 1.

As illustrated in FIG. 1, lamp 10 further includes an electrically insulating base member 25 which covers and is secured to the press-sealed end portion 15 of the lamp envelope adjacent the bulbous portion 13. This base member 25 may be of any suitable conventional design, e.g., that shown in U.S. Pat. No. 4,603,278 Devir et. al., which is incorporated by reference in the present application. The illustrated base member 25 is of a unitary construction and includes a relatively thicker upper portion 24 and a thinner protruding lower portion 24' adjacent the upper portion. Located within the lower portion 24' are a plurality of apertures 26, one of which is shown in FIG. 2 and each of which extends through the lower portion 24'. These apertures 26 are designed to receive the respective exteriorly-projecting portions of the lead-wires.

As shown in FIGS. 1 and 2, the upper portion 24 of the base member 25 includes groove means 51 for maintaining the exteriorly-projecting, exposed portions of the four lead wires in predetermined alignment on an external surface of one of the sidewalls of the upper portion of the insulating base member, thereby assuring that these exposed portions will be precisely aligned with corresponding electrical contacts 31 in a socket 33 that is designed to receive the base member 25.

The lamp is plugged into the socket 33 by inserting the protruding lower portion 24' of the base member 25 directly into the socket and pushing the base member further into the socket until the retained and aligned exposed portins of the respective lead wires 21, 21', 23, and 23', make good electrical connections with the contacts 31 in the socket.

Further details of the base are disclosed in the aforesaid U.S. Pat. No. 4,603,278—Devir et al, and reference may be had thereto if more information as to these details is desired.

When the lamp 10 is plugged into its socket 33, the lead wires 21 and 21' connect the filament 17 in an external electrical circuit via one set of the contacts 31, and the lead wires 23 and 23' connect the other filament 19 in an external electric circuit via another set of the contacts 31.

The primary use of the illustrated lamp is for automobile lighting and, particularly, for an application in which the filament 19 serves as a brake light source and the filament 17 serves as a parking light source. As pointed out hereinabove under BACKGROUND, automobile lamps may be subjected to appreciable vibration and shock as a result of engine vibration, travel over rough roads, impact to the car, etc. If the filament of such a lamp is of relatively heavy wire, as is the case with a brake light filament, it can readily withstand such vibrations and shock without damage. But the filament 17, which is used for a parking light source, is a fine-wire filament and is accordingly much less rugged and much more susceptible to damage by vibration and shock than the other filament 19. In the illustrated embodiment, filament 17 is of thoriated tungsten and has a diameter of 0.00219 inches.

Efforts have previously been made to reduce the chance for damage to such a fine-wire type filament by supporting the lamp on cushioning means (for example, by supporting the electrical socket 33 on cushioning means) so as to limit the amount of vibrational energy transmitted to the lamp. But the inclusion of such cushioning means involves extra expense, which auto manufacturers seek to avoid.

I am able to greatly improve the resistance of fine-wire filament 17 to damage from vibration and shock by utilizing a particular construction of the internal components of the lamp, specifically the filament 17 and the inner lead wire portions 60 and 62. More particularly, I construct these components in such a manner that the filament has a natural frequency of between 1.7 and 2.2 times the natural frequency of the inner lead-wire portions 60 and 62; and this relationship results in greatly improved resistance of the filament 17 to damage irom vibrations and shock.

The reiractory metal filament 17, would have a natural frequency of about 400 Hz if supported only by the inner lead-wire portions at its opposite ends, but this value of natural frequency is much too low to establish the desired natural frequency relationship with any practical iorm of inner lead-wire portions 60 and 62. Accordingly, I increase the natural frequency of the filament 17 to roughly 1500–1600 Hz by adding a support wire 70 that extends between a point midway of the filament length and the sealed end portion 15 of the glass envelope. This support wire is fixed at its lower end to the sealed end portion 15, being imbedded within the glass thereof during the envelope sealing operation when the glass is still soft. The upper end of the support wire 70 is twisted about the mid-section of the filament 17. The support wire is preferably of molybdenum and is of such a diameter and configuration that its natural frequency is substantially the same, or matches, that of the inner lead-wire portions 60 and 62. As seen in FIG. 1, the support wire 70 is embedded in one side of the sealed end portion 15 and shaped so as to extend outwardly to the opposite side of the filament 17. Additionally, support wire 17 extends to a point above the filament 17 and is then bent downward to be coupled to the filament 17.

With a filament having this relatively high natural frequency, i.e., about 1500–1600 Hz, it is feasible to construct the inner lead-wire portions 60 and 62 in such a manner that their natural frequency is substantially lower than that of the filament and, specifically, so low that the filament natural frequency is within the above-noted damage-resistant range of 1.7 to 2.2 times the natural frequency of the inner lead-wire portions. This relationship is achieved in the embodiment of FIGS. 1 and 2 by constructing each of the inner lead-wire portions 60 and 62 of a nickel-iron alloy (commonly referred to as 52 alloy) and preferably providing it with a diameter of about 0.020 inches.

The 52 alloy has the following composition:

Nickel and Cobalt: 50.0–51.0%

Manganese: 0.5% maximum

Silicon: 0.25% maximum

Iron: remainder

In one embodiment, the 52 alloy is grade FC7F (gas-free quarter hard).

The natural frequency (w) of a component, as referred to hereinabove, can be represented by the following expression:

$$w = \sqrt{k/m}$$

where k is a constant primarily dependent on the stiffness of the component, and m is the mass of the component.

It will be apparent from the above expression that employing a filament (17) having a natural frequency of 1.7 to 2.2 times that of the inner lead-wire portions 60 and 62 means that I utilize a filament that is much stiffer than the inner lead-wire portions. The inner lead-wire portions (60 and 62) have a relatively low stiffness that enables them to effectively, though not completely, isolate the filament from vibrations received by the lamp that have frequencies near the resonant frequency of the filament.

I determine the natural frequency of the filament, preferably, by arranging the lamp in conventional vibration-producing apparatus having means for controlling the frequency of vibration. When the apparatus is turned on to produce deflection of the filament at various frequencies, the deflection of the filament is observed with the assistance of a stroboscopic light. When the maximum deflection is observed, the frequency of the vibration then present is recorded. This frequency is the natural frequency of the filament. This test is made with the lamp in a deenergized condition.

The natural frequencies of the inner lead-wire portions and the support wire are similarly determined.

The frequency of the vibrations that produce maximum deilection of each of these components is the natural frequency of such component.

In arriving at the above-described 1.7 to 2.2 range of values for the ratio of filament natural frequency to the natural frequency of the inner leadwire portions, I have given major consideration to two important factors. One of these factors is the transmissibility ratio of the relevant lamp components (i.e., the acceleration of the filament produced by driving acceleration applied to the lamp divided by such driving acceleration). The other of these factors is what can be termed the "resonance avoidance" factor, or more specifically, the avoidance of resonance of the inner lead-wire portions (60 and 62) in any mode at all frequencies (i) that the lamp is likely to be subjected to and (ii) that will produce resonance with the filament (17).

With respect to transmissibility, I can limit the transmissibility ratio to about 0.5 if the natural frequency of the filament is made greater than 1.7 times the natural frequency of the inner lead-wire portions.

In general, the higher is this natural frequency ratio when a value of about 1.0 is exceeded, the lower is the transmissability ratio. But if the natural frequency ratio exceeds about 2.2, then a problem is likely to develop with the "resonance avoidance" factor. More specifically, a condition can develop in which the natural irequency of the inner-lead wire portions (60,62) in their second mode (or harmonic) of vibration will substantially match the natural frequency of the filament (17) in its first mode of vibration; and vibrations at this value of frequency can develop a damaging condition of resonance in which both the filament and the inner lead-wire portions are simultaneously vibrating at resonance. Hence, I avoid a natural frequency ratio exceeding about 2.2.

In considering the "resonance avoidance" factor described above, I have been particularly concerned with vibrations in the frequency range between 0 and 2000 Hz. This is the range set by the automobile industry to comprehend those values of frequency to which the lamp,while in use, is likely to be subjected by vibrations.

Another important feature of the lamp is that the support wire 70 is designed to have a natural frequency that substantially matches that of each of the inner lead-wire portions 60 and 62. This relationship helps to prevent these components irom vibrating in an out-of-phase mode which would tend to rip the filament apart by accelerating spaced portions of the filament in opposite directions.

The envelope of FIGS. 1 and 2 may be thought of as having a wedge-type base. But it is to be understood that my invention is not limited to an envelope and base of this particular type. For example, the invention is equally applicable to an envelope and base of the conventional type illustrated in FIGS. 3 and 4, where a glass stem tube 80 projects throught a neck portion 82 at the lower end of the glass envelope 83. The lead wires 21, 21', 23, 23', extend through the stem tube 80 in sealed relationship and are supported thereby. The stem tube is joined in sealed relationship to the neck of the envelope by means of a flange seal 85 at the lower end of the neck portion.

A metallic sleeve 90 surrounds the neck portion of the envelope and carries projections 87 and 88 for appropriately coupling with portions of a surrounding socket (not shown). The outer portions of two of the lead wires are suitably connected to this sleeve 90. At the lower end ofthe lamp there are two spaced-apart contacts 92 and 94 to which the outer portions of the other two lead wires are respectively connected in a conventional manner (not shown). An insulating member 95 electrical isolates these contacts 92 and 94 from each other and from sleeve 90.

Figure 4:
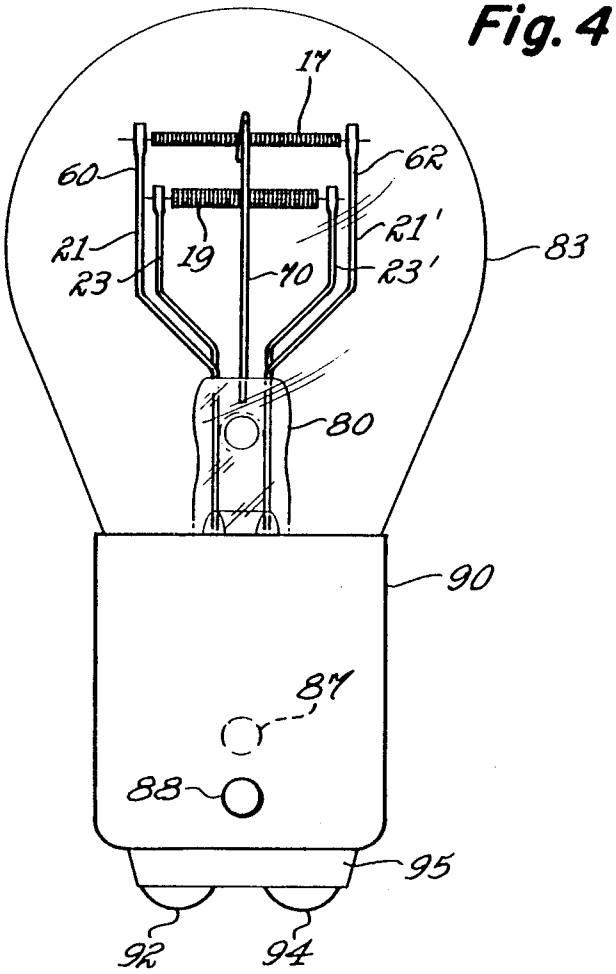
FIG. 4 is a side view of the lamp of FIG. 3 looking in the direction of arrows 4—4 in FIG. 3.
Figure 3:
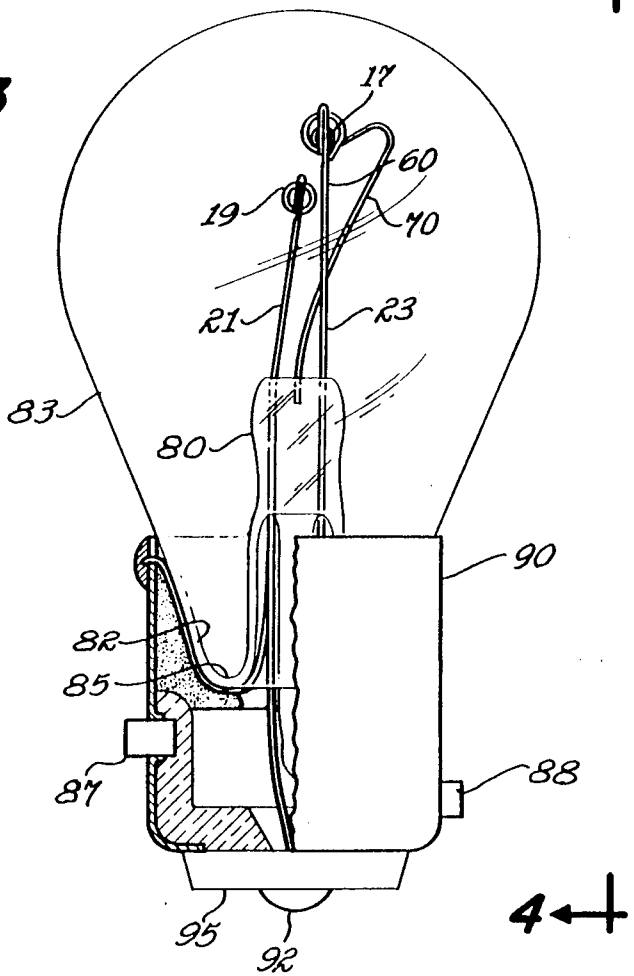
FIG. 3 is a side elevational view, partly in section, of a modified form of incandescent lamp.

In the embodiment of FIGS. 3 and 4, the filaments 17 and 19 are substantially the same as correspondingly designated components in the embodiment of FIGS. 1 and 2. The lead wires 21, 21', 23, and 23' of FIGS. 3 and 4 are similar to correspondingly designated parts in the embodiment of FIGS. 1 and 2 except that there are certain differences in shape and length that will be apparent from the drawings and certain other differences that are discussed hereinafter.

As in FIGS. 1 and 2, the fine-wire filament 17 has been provided with a support wire 70 to impart added stiffness to the filament. Support wire 70 has its lower end fixed to the stem tube 80 and its upper end fixed to filament 17 at a location midway of the filament length. As in FIGS. 1 and 2, the inner leadwire portions 60 and 62 have substantially the same natural frequencies; the support wire 70 has a natural frequency substantially the same as the natural frequency of each of the inner lead-wire portions 60 and 62; and the filament 17 has a natural frequency within the range of 1.7 to 2.2 times the natural frequency of the inner lead-wire portions 60 and 62.

In the embodiment of FIGS. 3 and 4 the inner lead-wire portions 60 and 62 are shorter than the correspondingly-designated inner lead-wire portions in FIGS. 1 and 2, and this tends to increase their natural frequency. To compensate for this latter effect, I construct each of the inner lead-wire portions 60 and 62 in the embodiment of FIGS. 3 and 4 of a soft copper material, preferably providing it with a diameter of about 0.014 inches and with a thin nickel-plated coating to protect it against otherwise possible surface oxidation. In one form of the invention, the copper is oxygen-free copper, a 99.95% pure copper that carries the industry designation C10200 copper.

The support wire 70 of FIGS. 3 and 4 is of molybdenum and serves the same purpose as the support wire 70 of FIGS. 1 and 2, i.e., stiffening fine-wire filament 17 so that the natural frequency of the filament is within the above-described damage-resistant range of 1.7 to 2.2 times that of the inner lead-wire portions 60 and 62. A range of about 2.0 to 2.2 provides especially high resistance to filament damage.

While I have shown and described particular emodiments of my invention, it will be obvious to those skilled in the art that various changes and modifications may be made without departing from my invention in its broader aspects; and I, therefore, intend herein to cover all such changes and modifications as fall within the true spirit and scope of my invention.

What I claim as new and desire to secure by Letters Patent of the U.S. is:

1. An incandescent lamp for use in applications that are subject to substantial vibration and shock, comprising:

(a) an envelope of light transmitting material comprising a sealing structure, (b) a pair of lead wires extending into the envelope through said sealing structure and supported by said sealing structure, each lead wire having a natural frequency of oscillation, (c) a refractory metal filament within the envelope having two ends respectively connected to said lead wires, and (d) a support wire having spaced apart ends respectively connected to said sealing structure and to a point on said filament spaced from the ends of the filament, the lamp being further characterized by: each of said lead wires including an inner lead-wire portion extending between said sealing structure and said filament, the inner lead-wire portions having substantially the same natural frequencies, and the filament having a natural frequency of between 1.7 and 2.2 times the natural frequency of each inner lead-wire portion when the lamp is deenergized, thereby protecting the filament against damage from vibrational energy applied to said envelope and further wherein said lead wires and said filament are disposed in one plane and wherein said support wire has at least two bends and crosses said one plane so as to be connected to one side of said sealing structure at the one end and to the opposite side of said filament at the other end.

2. An incandescent lamp as defined in claim 1 in which said support wire has a natural frequency substantially the same as that of said inner lead-wire portions.

3. The lamp of claim 1 in which said filament has a natural frequency of about 2.0 to 2.2 times the natural frequency of each of said inner lead-wire portions.

4. The lamp of claim 1 in which said inner leadwire portions are of soft copper.

5. The lamp of claim 2 in which said inner leadwire portions are of soft copper.

6. The lamp of claim 3 in which said inner leadwire portions are of soft copper.

7. The lamp of claim 2 in which said inner leadwire portions are of soft copper and said support wire is of molybdenum.

8. A lamp for automobile lighting as defined in claim 1 and in which said filament is a fine-wire filament that normally serves as a source for a parking 9. The lamp of claim 8 in which said fine-wire filament has a diameter of about 2 thousands of an inch.

10. A lamp as deiined in claim 1 and iurther characterized by the iollowing parameters:

(a) material of filament: consisting essentially of tungsten (b) diameter of filament: about 2 thousands of an inch (c) material of inner lead-wire portions: consisting essentially of pure copper (d) diameter of inner lead-wire portions: about 14 thousands of an inch (e) material of support wire: consisting essentially of molybdenum.

11. A lamp as defined in claim 10 in which the filament has a natural frequency of about 2 to 2.2 times the natural frequency of each of said inner lead-wire portions.

12. The lamp of claim 2 in which said filament has a natural frequency of about 2.0 to 2.2 times the natural frequency of each of said inner lead-wire portions.

* * * * *